US005524553A

United States Patent [19]

Argabright

[11] Patent Number: 5,524,553

[45] Date of Patent: Jun. 11, 1996

[54] PLAN TABLE

[76] Inventor: John Argabright, 7735 S. 73rd East Ave., Tulsa, Okla. 74133

[21] Appl. No.: 345,496

[22] Filed: Nov. 28, 1994

Related U.S. Application Data

[63] Continuation-in-part of Ser. No. 76,819, Aug. 27, 1993, abandoned.

[51] Int. Cl.[6] ..... A47B 3/06; A47B 27/00

[52] U.S. Cl. ..... 108/25; 312/231

[58] Field of Search ..... 108/14, 25, 153, 108/26; 312/231, 9.2, 293.3, 293.1, 287; 206/1.8, 214, 215, 224, 225, 371, 407; 220/503, 505

[56] References Cited

U.S. PATENT DOCUMENTS

| | | | |
|---|---|---|---|
| 1,142,941 | 6/1915 | Deal | 312/293.1 X |
| 2,240,395 | 4/1941 | Evans | 108/25 X |
| 2,285,576 | 6/1942 | Fox | 108/25 X |
| 2,972,506 | 2/1961 | Haag | 108/25 X |
| 3,290,108 | 12/1966 | Beckman et al. | 312/281 |
| 4,122,780 | 10/1978 | Brickman | 108/25 |
| 4,176,743 | 12/1979 | Fitzpatrick | 108/25 X |
| 4,177,737 | 12/1979 | Brickman | 108/25 X |
| 4,574,504 | 3/1986 | Holmer | 206/225 X |
| 4,682,827 | 7/1987 | Woodward | 312/231 |
| 4,723,821 | 2/1988 | Montgomery | 312/231 |
| 4,969,698 | 11/1990 | Maynard, Jr. | 312/231 X |
| 5,018,609 | 5/1991 | Brenner | 206/225 X |
| 5,133,290 | 7/1992 | De Marco et al. | 206/407 X |
| 5,195,441 | 3/1993 | Kay | 108/25 X |
| 5,218,912 | 6/1993 | Buske | 108/26 |

FOREIGN PATENT DOCUMENTS

| | | | |
|---|---|---|---|
| 1124473 | 2/1955 | France | 108/25 |
| 1423107 | 12/1966 | France | 312/231 |

*Primary Examiner*—Peter M. Cuomo
*Assistant Examiner*—Robert J. Sandy
*Attorney, Agent, or Firm*—Head, Johnson & Kachigian

[57] ABSTRACT

A plan table having a flat table top for supporting a plan or plans. A pair of opposed side supports support the table top from the floor. A plurality of cylinders or tube are provided to receive rolled up plans. Each cylinder or tube extends through circular openings in the opposed side supports and each cylinder has at least one open end. A mechanism is provided to removably seal each cylinder open end to provide a sealed enclosure for storage of the plans.

7 Claims, 2 Drawing Sheets

PLAN TABLE

CROSS-REFERENCE OF THE APPLICATION

This application is a continuation-in-part application of U.S. patent application Ser. No. 08/076,819 filed Aug. 27, 1993, now abandoned, entitled WEATHERPROOF PLAN TABLE.

BACKGROUND OF THE INVENTION

1. Field of the Invention

The present invention is directed to a plan table which may be used outdoors near a construction site, such as a building construction site, and may store plans in cylindrical tubes which are capable of being sealed from the elements.

2. Prior Art

In the construction field, large sheet paper plans, such as blueprints, are used continuously during the construction process. These plans are often in rolled up fashion to form a cylinder when being stored or transported. When in use, the plans are unwound and placed in flat condition.

To use the plans, they may be placed on a table in an office or trailer building near the site. While this is satisfactory for use of the plans, a considerable amount of back and forth travel is required to the actual construction site. Alternatively, plans can also be used on an open air table or other desk nearer to the construction site, although they must be transported during inclement weather or at the end of the day to a storage site.

Previous attempts have been made to combine a work table with storage areas—examples of which are shown in Haag (U.S. Pat. No. 2,972,506), Kay (U.S. Pat. No. 5,195,441), Buske (U.S. Pat. No. 5,218,912) and Maynard (U.S. Pat. No. 4,969,698). None disclose or suggest sealed containers for storage of plans.

There is a need, therefore, to provide a rugged and inexpensive work table that may be brought close to the work site and that will support plans during use and will also provide sealed enclosures for multiple plans.

It is an object and purpose of the present invention to provide a plan table for large size plan sheets that may be used on a flat table top and then stored in cylindrical or tubular containers having a removable end cap that will create sealed containers for storage of the plans.

It is a further object and purpose of the present invention to provide a plan table that is rugged in construction and impervious to the elements.

SUMMARY OF THE INVENTION

The present invention provides a plan table which will support sheets of plans of various dimensions, such as blueprints. The plans are supported by a flat table top that may be parallel with the floor or ground or, may be at a slight angle thereto, for ease of viewing. The flat table top includes an upstanding lip to prevent pencils or the like from rolling off of the table top.

A pair of opposed side legs or side supports extend between the floor or ground and the table top. The side panels are opposed and parallel to each other. The tops of the side panels extend slightly beyond and above the level of the table top.

Extending from the back of each side panel is a back panel which is perpendicular to the floor or ground and perpendicular to each of the side panels. The back panel, likewise, extends slightly above the level of the table top in the same manner as the side panels.

A plurality of tubes or cylinders extend between the side panels. Each tube or cylinder passes through a circular opening in each side panel and may be welded or otherwise affixed to the side panels. Each tube or cylinder has at least one open end. The cylinders or tubes are closed containers except for an opening at the end.

Removable end caps will seal each open end of each cylinder or tube. In order to store the plans, they are rolled up and then inserted axially into the open end of the cylinder or tube. Thereafter, the end cap will be secured to the open end to form a sealed container. To remove the plans, the reverse procedure is performed.

An additional tubular holder having an open end is provided for storage of pencils, rulers, and the like. A removable end cap may be threadably secured to the tubular holder open end to form a sealed container.

DETAILED DESCRIPTION OF THE PREFERRED EMBODIMENTS

Figure 1:
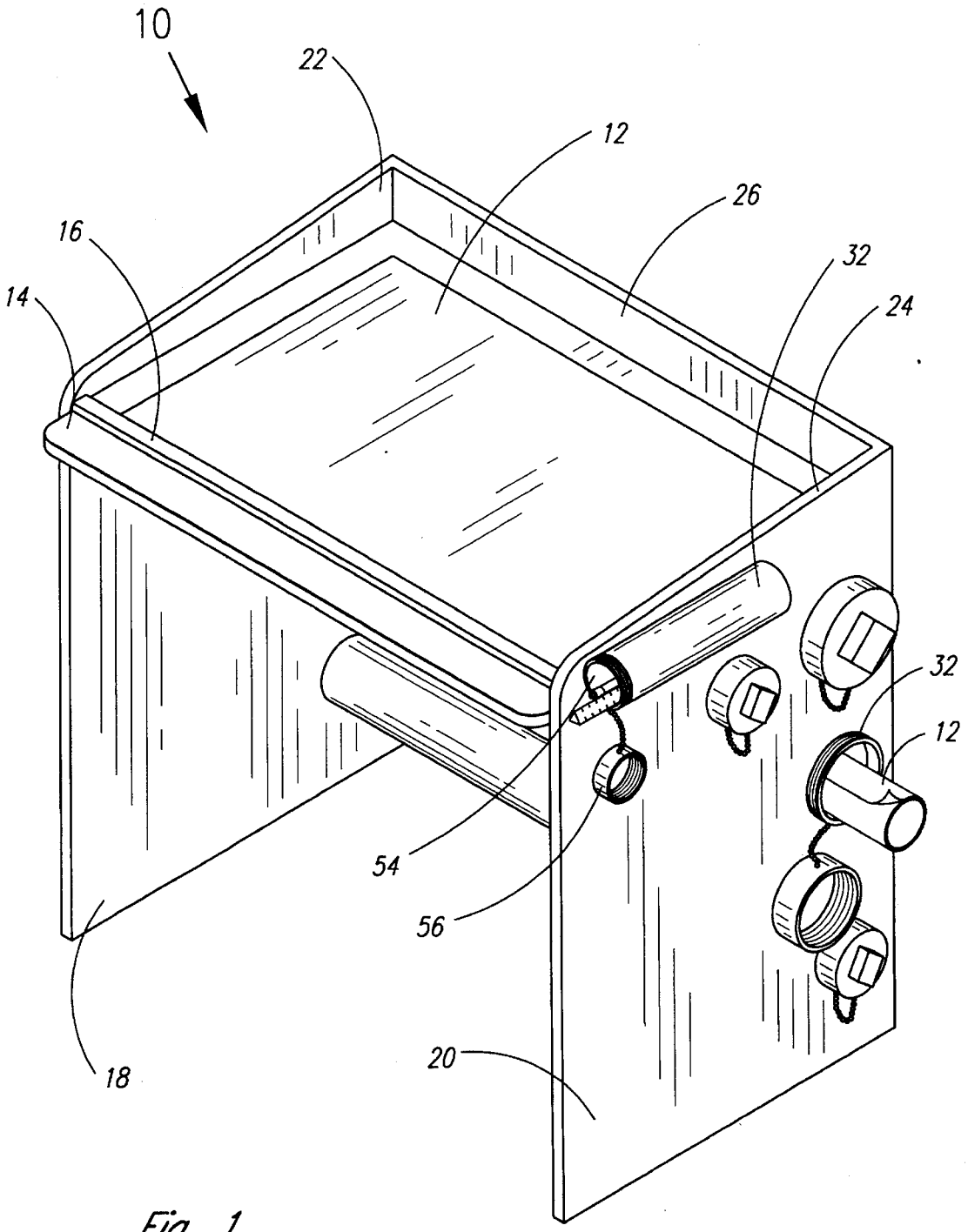
FIG. 1 is a perspective view of a plan table constructed in accordance with the present invention.

Referring to the drawings in detail, FIG. 1 is a perspective view of a plan table 10 constructed in accordance with the present invention. A number of sheets of plans, such as blueprints 12, are shown in the flat, open position in FIG. 1. While the plans may take various dimensions, the sheets are typically difficult to hold in the user's hands and are best laid on a flat surface for reading or working thereon. When the plans 12 are stored or transported, they are rolled up to form a tube.

The plans are supported by a flat table top 14. The table top 14 may be parallel with the floor or ground (not shown) or, as shown in FIG. 1, may be a slight angle thereto for ease of viewing. The table top will also support pencils and other materials as shown.

The table top 14 includes an upstanding lip 16 to provide a shoulder for the plans and to prevent pencils or the like from rolling from the table top. In one embodiment, the table top is approximately 40 inches by 34 inches, large enough for various size plans, although other dimensions are possible within the scope of the invention.

A pair of opposed side legs or side supports 18 and 20 extend between the floor or ground (not shown) and the table top 14.

In the embodiment shown, the side panels 18 and 20 are opposed and parallel to each other. The tops of the side panels 18 and 20 extend beyond and above the level of the table top slightly at 22 and 24, respectively.

In the embodiment shown, the side panels 18 and 20 are approximately 34 inches high by 34 inches wide, although other dimensions may be employed.

Extending from the back edge of each side panel 18 and 20 is a back panel 26. The back panel is perpendicular to the floor or ground and perpendicular to each of the side panels 18 and 20. The back panel 26 extends slightly above the level of the table top in the same manner as the side panels.

Figure 2:
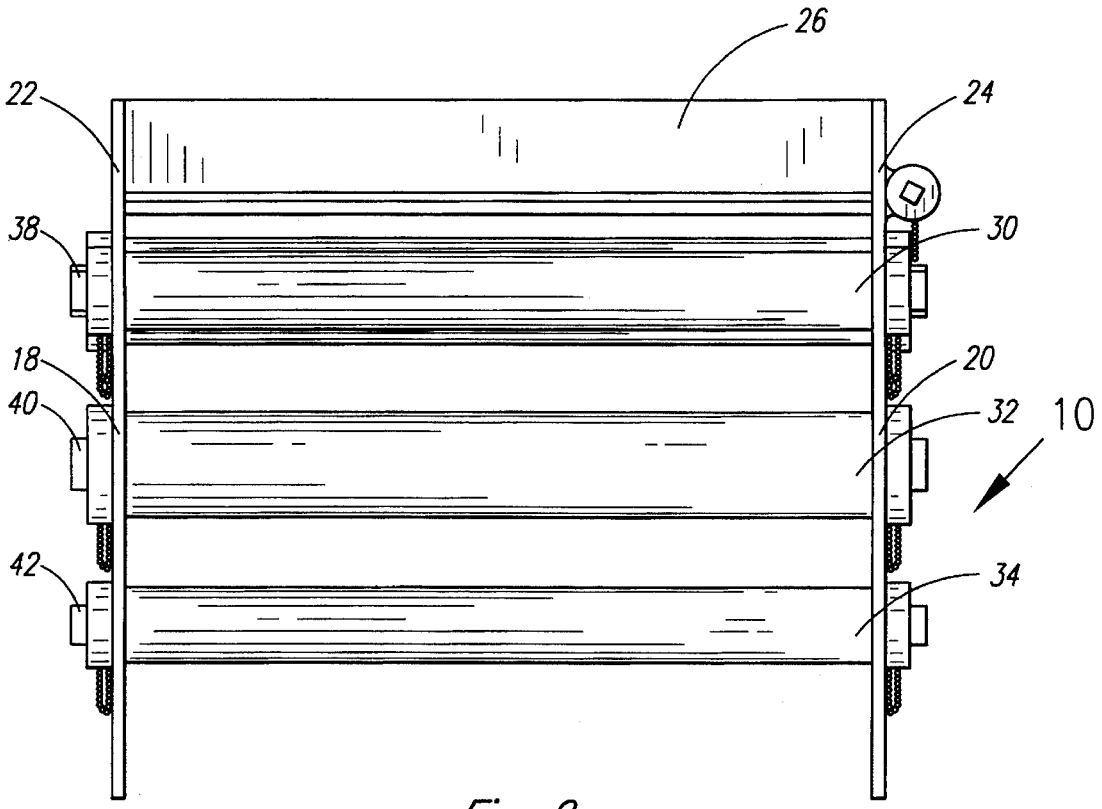
FIG. 2 is a front view of the plan table shown in FIG. 1.

A plurality of tubes or cylinders extend between the side panels 18 and 20. With reference to FIG. 2 and continuing reference to FIG. 1, a plurality of tubes or cylinders extend between the side panels 18 and 20. Each tube passes through a circular opening in each side leg 18 and 20 and may be welded or otherwise affixed to the side panels.

Each tube or cylinder has at least one open end. In the embodiment shown, the tubes or cylinders have an open end on each end.

The side panels 18 and 20, and back panel 26 may be constructed of a rugged and weatherproof material such as plastic.

In the embodiment shown, there are four tubes or cylinders 28, 30, 32, and 34. By having a plurality of tubes, a large number of plans may be stored in the table. The cylinders or tubes 28, 30, 32, and 34 are closed containers except for an opening at each end.

Figure 3:
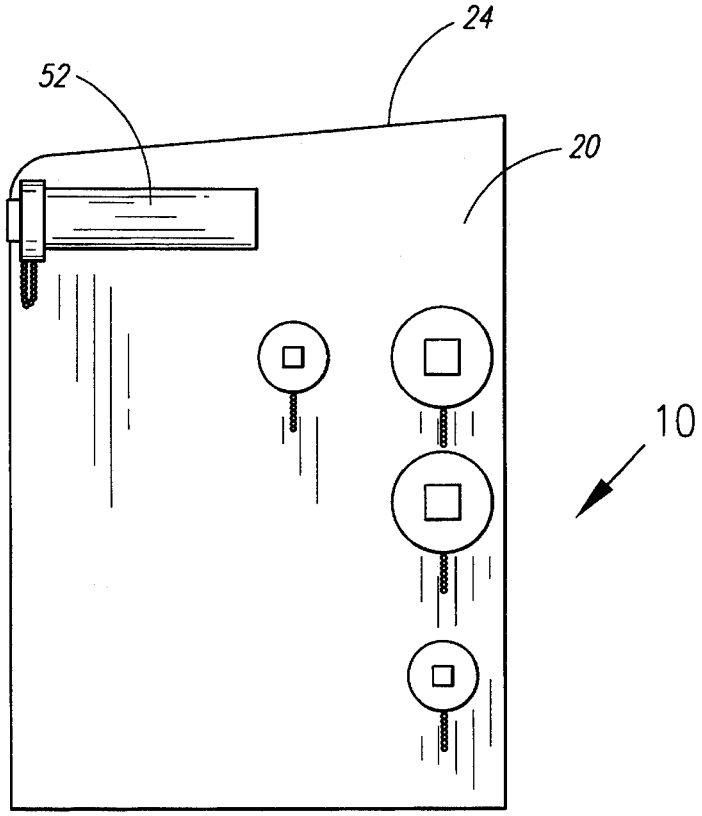
FIG. 3 is a side view of the plan table shown in FIG. 1.

As seen in FIG. 2, the cylinders or tubes 28, 30, 32, and 34 are shown with removable end caps 36, 38, 40, and 42 at side panel 18. At the opposite side panel 20, removable end caps 44, 46, 48, and 50 seal each cylinder or tube as best seen in FIG. 3.

When the plans 12 are to be stored, they will be rolled up and then inserted axially into the tube as best seen in FIG. 1 wherein plans 12 are partially inserted into cylinder or tube 32. When the plans are fully within the tube or cylinder, the end cap 48 therefor will be sealably closed on the opening. The cylinder, thus, maintains the cylindrical shape of the plan roll.

As shown, each end cap has a threaded connection with its corresponding cylinder or tube. Other types of removable closures are, of course, possible within the scope of the present invention.

Additionally, each end cap is secured by a cord or chain to the respective open end of the tube to prevent the end cap from being misplaced or lost.

A tubular holder 52 is attached or otherwise affixed to side panel 20 and has at least one open end 52. Pencils, rulers, or other items may be stored within the tubular holder 52. A removable end cap is threadably connected to the open end to form a sealed container.

It will thus be seen that all of the plans and other items may be stored in sealed containers impervious to the elements, dirt, dust and other hazards of the construction site.

The table 10, itself, is lightweight and may be transported easily close to the work site.

Whereas, the present invention has been described in relation to the drawings attached hereto, it should be understood that other and further modifications, apart from those shown or suggested herein, may be made within the spirit and scope of this invention.

What is claimed is:

1. A plan table, comprising:

a flat table top for supporting a plan or plans;

a pair of side legs extending from said table top;

a plurality of tubes, each said tube extending between said side legs and having at least one open end, each said tube perpendicular to said side legs and passing therethrough; and a removable end cap for each said tube open end for insertion and removal of said plans, each said tube having a threaded connection with said end cap.

2. A plan table as set forth in claim 1 including a cord or chain extending between each said tube open end and said end cap.

3. A plan table as set forth in claim 1 wherein said flat table top and said side legs are weather proof.

4. A plan table as set forth in claim 1 including a tubular holder for pencils and the like attached on one of said side legs and a removable end cap to create a sealed enclosure.

5. A plan table as set forth in claim 1 including a back panel perpendicular to and extending between said side legs.

6. A plan table, comprising:

a flat table top for supporting a plan or plans;

a pair of opposed side supports to support said table top;

a back panel perpendicular to said side supports wherein said side supports and said back panel extend slightly above the level of said table top;

a plurality of cylinders, each cylinder extending through circular openings in said opposed side supports and each cylinder having at least one open end;

means to removably seal each said cylinder open end to provide a sealed enclosure for said plans wherein each said cylinder open end has a threaded connection; and a tubular holder for pencils and the like attached on one of said supports and a removable end cap to create a sealed enclosure.

7. A plan table as set forth in claim 6 including a cord or chain extending between each said cylinder open end and said removable closure.

* * * * *